US007523876B2

(12) United States Patent
Wolfe

(10) Patent No.: US 7,523,876 B2
(45) Date of Patent: Apr. 28, 2009

(54) ADJUSTABLE LIQUID ATOMIZATION NOZZLE

(75) Inventor: Joseph E. Wolfe, Richboro, PA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 157 days.

(21) Appl. No.: 11/789,119

(22) Filed: Apr. 9, 2007

(65) Prior Publication Data

US 2008/0245898 A1 Oct. 9, 2008

(51) Int. Cl.
*B05B 1/30* (2006.01)

(52) U.S. Cl. ..... 239/581.1; 239/416.5; 239/420; 239/424; 239/433; 239/525; 239/537; 239/601; 169/15

(58) Field of Classification Search ..... 239/416.5, 239/417, 417.3, 420, 422–424, 428, 433, 239/434.5, 451, 453, 525, 537–540, 581.1, 239/601; 169/14, 15

See application file for complete search history.

(56) References Cited

U.S. PATENT DOCUMENTS 3,701,480 A * 10/1972 Kuhner et al. ..... 239/420
4,300,723 A * 11/1981 Prasthofer ..... 239/601
5,312,041 A * 5/1994 Williams et al. ..... 239/423
5,520,331 A * 5/1996 Wolfe ..... 239/434.5
6,889,773 B2 * 5/2005 Hanratty ..... 169/15

* cited by examiner

*Primary Examiner*—Steven J Ganey
(74) *Attorney, Agent, or Firm*—Mark O. Glut

(57) ABSTRACT

An apparatus for mixing two or more fluids, gases or other substances and conveying said fluids, gases or other substances through a convergent-divergent (C-D) nozzle to produce a highly atomized output flow that is adjustable from no atomization to full atomization, said preferred embodiment of said apparatus having a housing and a nose portion and a gripping portion, the housing including an outer conduit and an inner conduit, the outer and inner conduits positioned and arranged to convey fluids, gases and other substances from an entry point to an exit point and into the entry end of a C-D nozzle and through said C-D nozzle to produce an output flow. The location of the outer conduit, inner conduit and C-D nozzle may be adjusted to vary the output flow from no atomization to full atomization. The pressure and flow rate in each conduit may also be separately adjusted to obtain the desired output flow.

13 Claims, 6 Drawing Sheets

ADJUSTABLE LIQUID ATOMIZATION NOZZLE

The invention described herein may be manufactured and used by or for the Government of the United States of America for Government purposes without the payment of any royalties therein or therefore.

BACKGROUND OF THE INVENTION

The present invention relates to liquid atomizing nozzles. More specifically, but without limitation, the present invention relates to an adjustable, portable, hand held device that is especially useful to mix and atomize two or more fluids for fire protection. Fluorocarbon based fire extinguishing agents are allegedly environmentally harmful since they apparently cause depletion of the Earth's ozone layer. Present United States law and United States treaty agreements require the replacement and phasing out of such materials under the 1988 Montreal Protocol, which classified Halon as a Class I Ozone Depleting Substance (ODS). In addition, the United States Clean Air Act Amendments of 1990 called for a ban on production of Halon in the United States after January 1994.

These laws also prohibited the purposeful venting of these harmful substances and required training of the personnel involved in their use in an attempt to minimize the emission of such substances into the atmosphere. The United States Navy has responded to these prohibitions and requirements by itself prohibiting the use of OSDs in new procurement contracts. To find replacements for traditional systems using banned substances, the Navy continues to conduct research to find new ways and alternate designs for fire extinguishing systems.

Fine Water Mist (FWM) type systems have very favorable characteristics as replacements for existing Halon systems and are continuing to be studied by Navy scientists and engineers. Typically, these systems include nozzles for creating misting fluids using pressurized gas and continue to show favor as a mechanism for fire prevention. In these systems, a liquid is typically directed into a central bore of the nozzle, the central bore directing a flow of high velocity gas. In some nozzles, the velocity and pressure of the gas are increased in a narrowed throat area of the bore which causes the atomization of the fluid into small droplets as the gas travels through the nozzle. To aid atomization and provide an unobstructed flow path of the gas, the fluid is usually injected into the gas stream through an aperture in the bore wall so that the two different fluid streams impinge at approximately a 90 degree angle. Nozzles of the above described type require high pressure spraying of the liquid and the gas. This is undesirable. Another problem with mixing nozzles of this type is the need for fine holes, e.g. holes of a small diameter. These small holes are easily clogged and worn causing the mixture to exit the nozzle at a reduced level of efficiency and effectiveness.

The use of liquid only, water based systems for fire extinguishment is effective and these systems create water droplets by deflecting the water flow just ahead of the spouting aperture. However, the droplet size is large and the desirable fine water mist cannot be achieved.

Therefore, the need for a low pressure, reliable liquid/gas mixing nozzle is desirable and is achieved in U.S. Pat. No. 5,520,331 entitled "Liquid Atomizing Nozzle" which is hereby incorporated by reference. This patent discloses a nozzle structure that produces an extremely fine liquid atomization through low pressurization of the liquid and gas being delivered to the nozzle. The fluid and gas are delivered through relatively large apertures thus effecting minimal wear and clogging of those apertures. In this patent, the nozzle disclosed is a convergent/divergent nozzle, hereinafter referred to as a "C-D" gas nozzle attached to a mixing block having a delivery tube with an aperture that is centered within a gas conduit located upstream of a narrowed throat. However, there is no apparatus disclosed or suggested for controlling/adjusting the output of the C-D nozzle or adapted to allow use of the C-D nozzle in particular environments.

There is therefore a need for replacement designs for existing Halon systems, especially in the areas of fire suppression and also in the areas of first responders, to provide an apparatus, using the C-D nozzle, for effective and efficient fire fighting and to quickly prevent fires from spreading. There is also a need for an apparatus for otherwise delivering the output of the C-D nozzle in a manner that permits the operator to effectively control and tailor the output in the most efficient manner in a package that can be portable and easy to handle by a single operator.

SUMMARY OF THE INVENTION

The present invention provides an improvement to the above described invention and relates to the controllability/adjustability, ease of use, and portability of the present invention.

The preferred embodiment of the apparatus of the present invention is an apparatus for mixing two or more fluids, gases or other substances in any combination thereof and comprises a housing having a nose portion and a gripping portion, the housing including an outer conduit and an inner conduit, the outer and inner conduits positioned and arranged to convey liquids, fluids and other substances from an entry point to an exit point, the exit point of the inner conduit located forwardly of the exit point of the outer conduit and a fluid activation sleeve slidably attached to the nose portion, the fluid activation sleeve having a C-D nozzle therein, the C-D nozzle including a convergent portion of changing X-sectional area and having an entry end and an exit end, the entry end having a larger X-sectional area than the X-sectional area of the exit end, the C-D nozzle also having a divergent portion of changing X-sectional area and having an entry end and an exit end, the entry end having a smaller X-sectional area than the X-sectional area of the exit end, the exit end of the convergent portion abutting the entry end of the divergent portion, the exit end and the entry end having the minimum X-sectional area of the C-D nozzle, the entry end of the convergent portion located proximate the exit point of the inner conduit, the fluid activation sleeve slidably adjustable to alter the distance between the C-D nozzle and the exit end of the inner conduit to position said C-D nozzle from a most rearwardly position blocking off the flow of the fluids, gases or other substance from the outer conduit and allowing only fluids, gases or other substances to flow from the inner conduit to a most forwardly position permitting said fluids, gases or other substances to flow from the outer conduit and mix with the fluids, gases or other substances from the inner conduit in the convergent portion of said C-D nozzle.

The preferred embodiment of the method of the present invention is a method for producing and controlling an output flow from a convergent/divergent nozzle from two or more pressurized flow streams, the output flow being controllable/adjustable and said output flow having a variable degree of mixing and atomization. The steps of this method include providing 2 or more pressurized flow streams as outputs from separate conduits; positioning and arranging the output flow streams in a concentric manner; positioning and arranging the output flow streams and the entry end of a convergent/divergent nozzle in a concentric manner; directing the flow streams into the entry end of a convergent/divergent nozzle; adjusting the location of one or more of the output flow streams relative to one another; adjusting the location of the entry end of a convergent/divergent nozzle relative to the output flow streams to produce and control the degree of atomization of the output from the convergent/divergent nozzle.

The improvements of the present invention provide superior results over the prior art. The present invention provides increased (better) mixing and superior atomization and the ability to tailor the output under different conditions. This is accomplished in an apparatus that can be easily hand held by the operator and operated to instantaneously tailor the output to changing conditions. The present invention greatly reduces the back momentum forces that are generated in prior art devices and methods and enables one operator to operate the present invention and/or utilize the present method easily and without significant exertion thereby preventing premature fatigue. Accordingly, a single operator may easily handle and operate the present invention and/or utilize the present method for time periods that exceed the time that prior art devices and methods may be employed. The improvements of the present invention provide a need for only one operator when used in a hand held configuration, greatly reduces back momentum forces and reduces physical exertion. The present invention has superior anti-clogging and anti-wear capabilities due to the combination of components and interrelation thereof.

DETAILED DESCRIPTION OF THE PREFERRED EMBODIMENT

Figure 1:
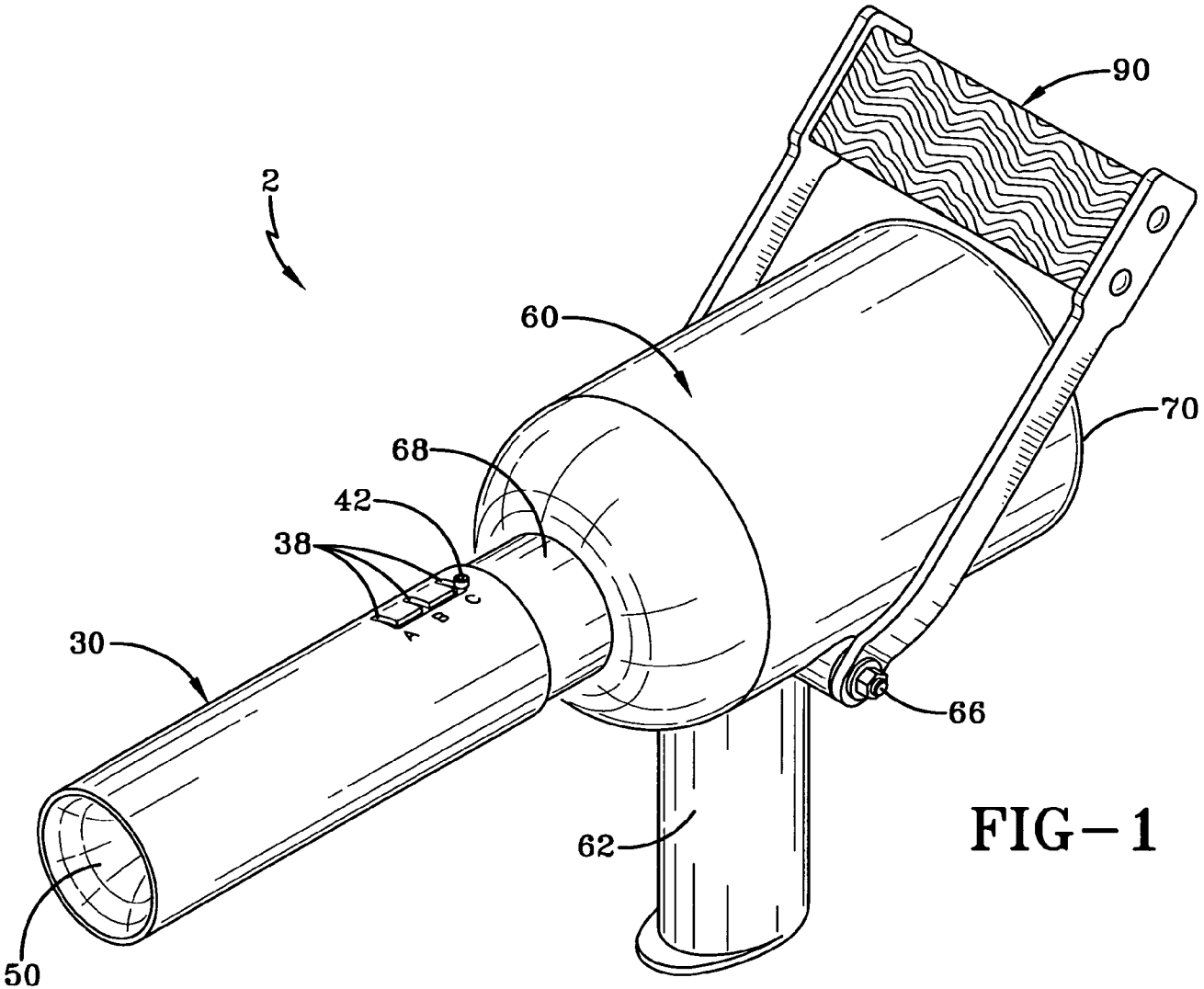
FIG. 1 is a perspective of the present invention.

The preferred embodiment of the present invention is illustrated by way of example in FIGS. 1-5. As shown in FIG. 1, Adjustable Liquid Atomizing Nozzle (ALAN) 2 includes fluid activation sleeve 30, housing 60, and bail handle 90. Note, that in the preferred embodiment, fluid activation sleeve 30 is located forwardly of housing 60. Housing 60 is shaped to include a grasping portion that may be held by the hand of an operator and is indicated as grip 62 and extends downwardly from housing 60. Housing 60 includes nose 68 which extends forwardly from housing 60. Bail handle 90 is attached to ball valve actuation rod 66 of ball valve 80 on the left side of housing 60, as shown in FIG. 1, and bail handle 90 is attached to the other end (not shown) of ball valve actuation rod 66 on the other side of housing 60. In applications where ball valve actuation rod 66 does not extend outwardly to both sides of housing 60, a dummy pivot, located on the same axis as ball valve actuation rod 66, may be utilized. Housing 60 may be constructed as a unitary piece or made from several parts and may be, for example, fabricated as a single molded piece or from several pieces. Housing 60 may also be fabricated from several metallic parts, such as, brass, aluminum or steel or machined or otherwise fabricated from a single billet.

Figure 2:
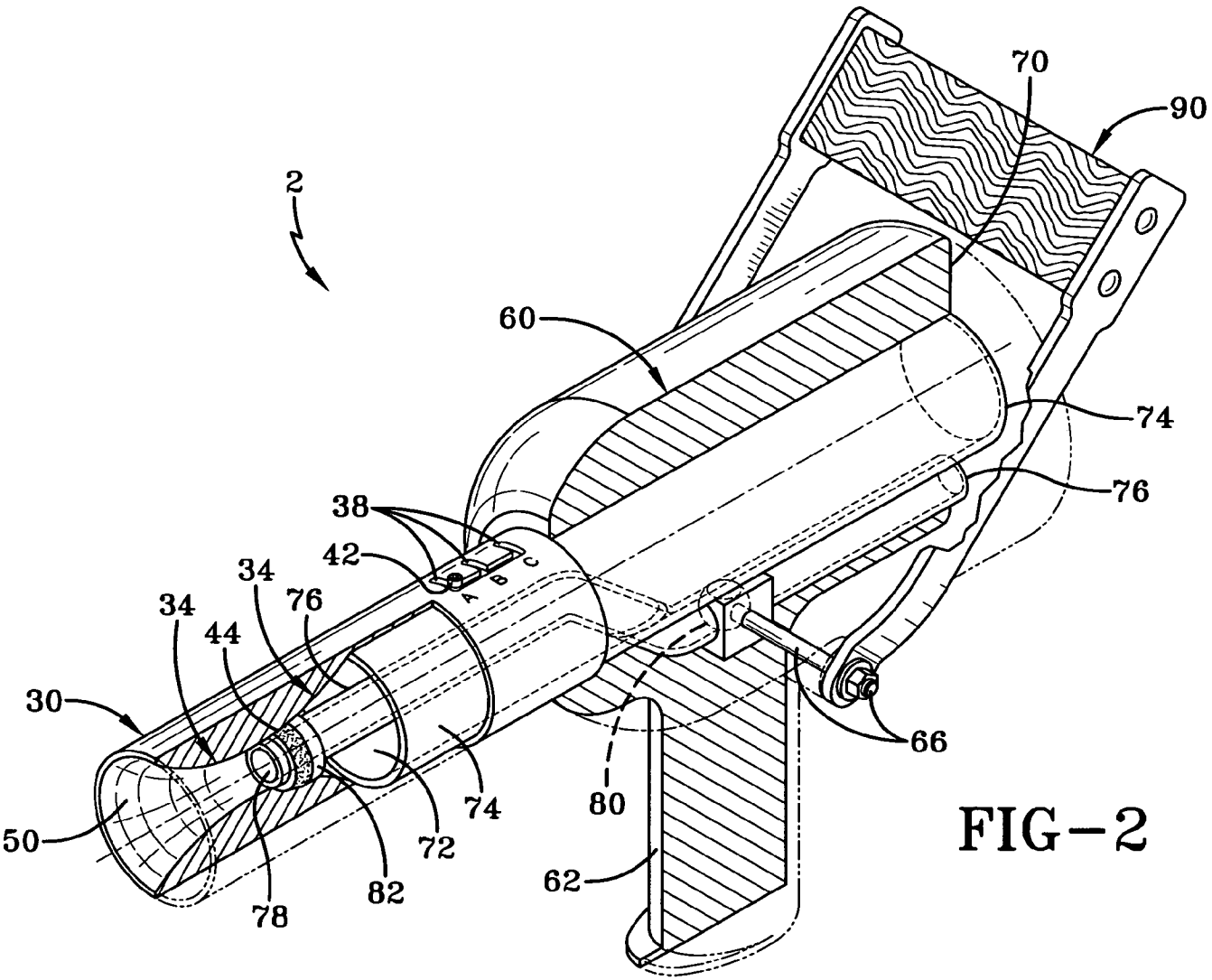
FIG. 2 is a perspective view of the present invention showing the liquid and gas conduits, and the C-D nozzle in phantom.

As shown in FIG. 2, housing 60 includes air supply conduit 74 which extends from rear surface 70 of housing 60 to outlet 72 of housing 60. A fitting (not shown) may be attached to air supply conduit 74 proximate rear surface 70 so that an air supply source may be easily attached to air supply conduit 74. It shall be noted that FIG. 2 shows nose 68 omitted as air supply conduit 74 extends outwardly and forwardly from housing 60. In this way, air supply conduit 74 may serve as nose 68 for the intended purpose of nose 68.

Housing 60 also includes water supply conduit 76 which extends from rear surface 70 of housing 60 forwardly a distance "w" beyond outlet 72. (See FIG. 5 wherein outlet 78 of water supply conduit 76 is shown to extend outwardly and forwardly a distance "w" from outlet 72 of air supply conduit 74). Note, that in the preferred embodiment distance "w" is theoretically approximately equal to the length of convergent portion, c, of C-D nozzle 34 and to the length of divergent portion, d, of C-D nozzle 34. Gasket 82 is located around water supply conduit 76 and is positioned and arranged to abut the inner surface of convergent portion c of C-D nozzle 34 when fluid activation sleeve 30 is positioned in the fully closed position "A" (see FIGS. 4 and 5).

Figure 4:
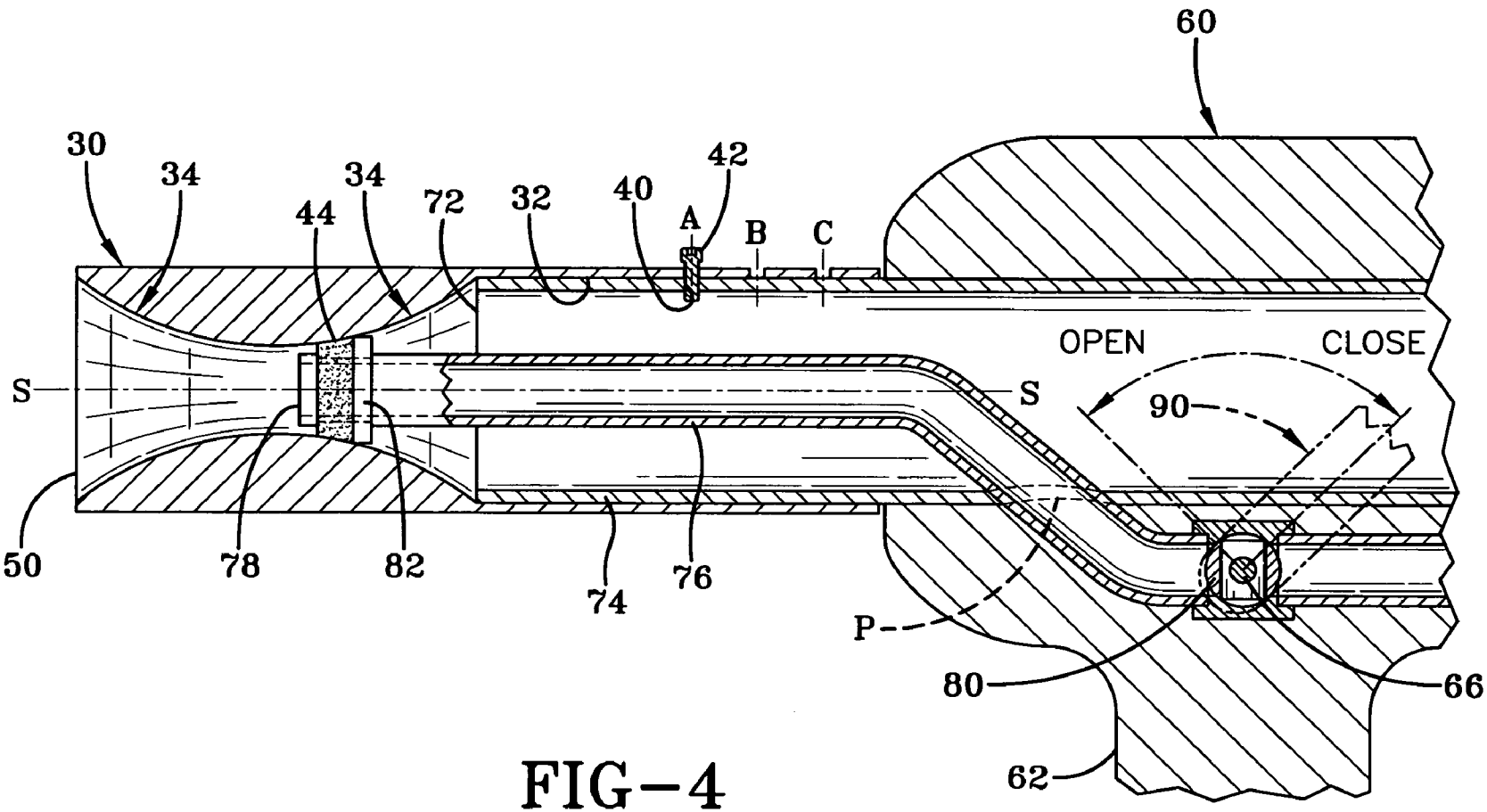
FIG. 4 is a X-section of a portion of the present invention showing the C-D nozzle in the closed position.
Figure 5:
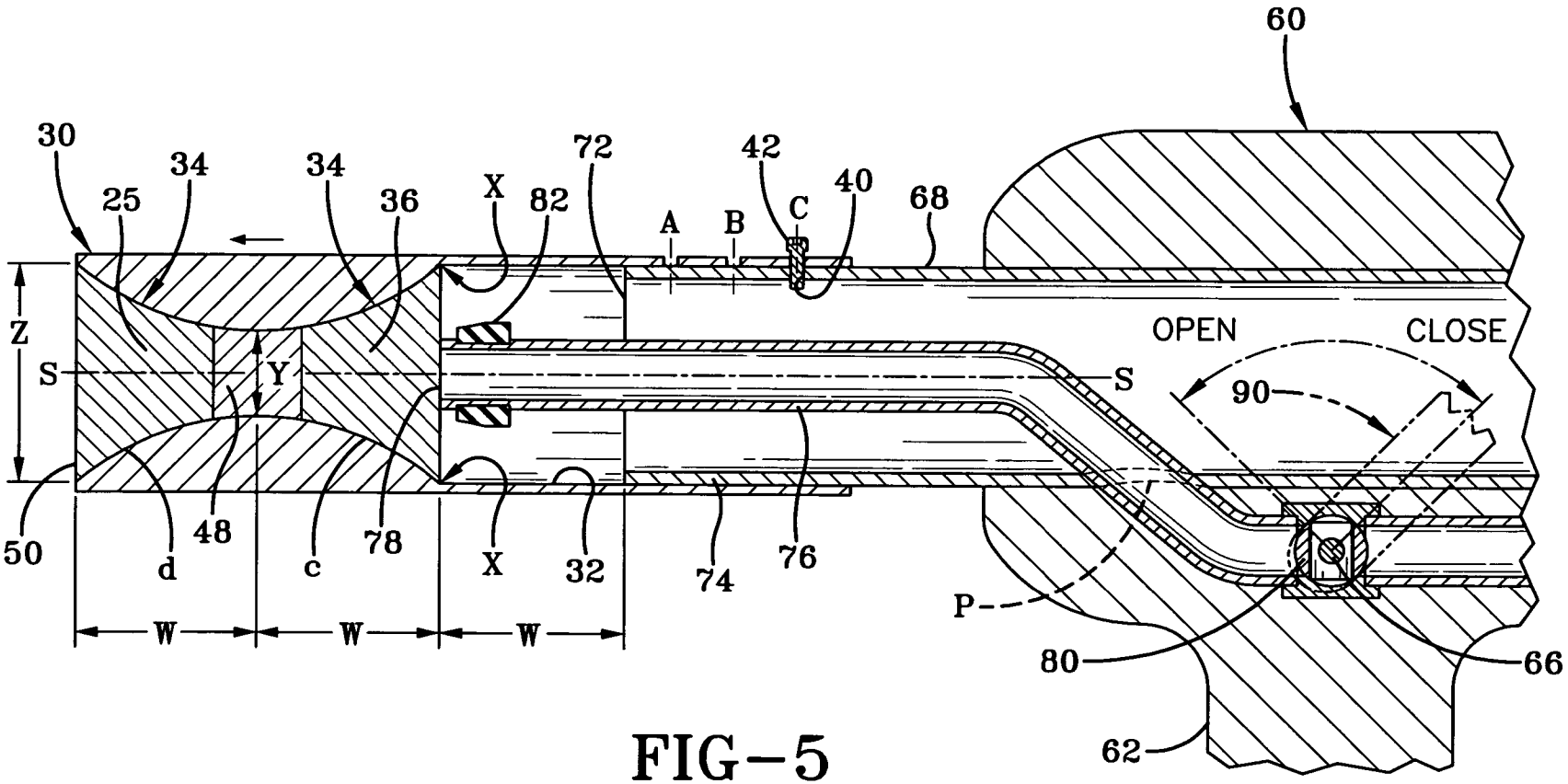
FIG. 5 is a X-section of a portion of the present invention showing the C-D nozzle in the open position.
Figure 6:
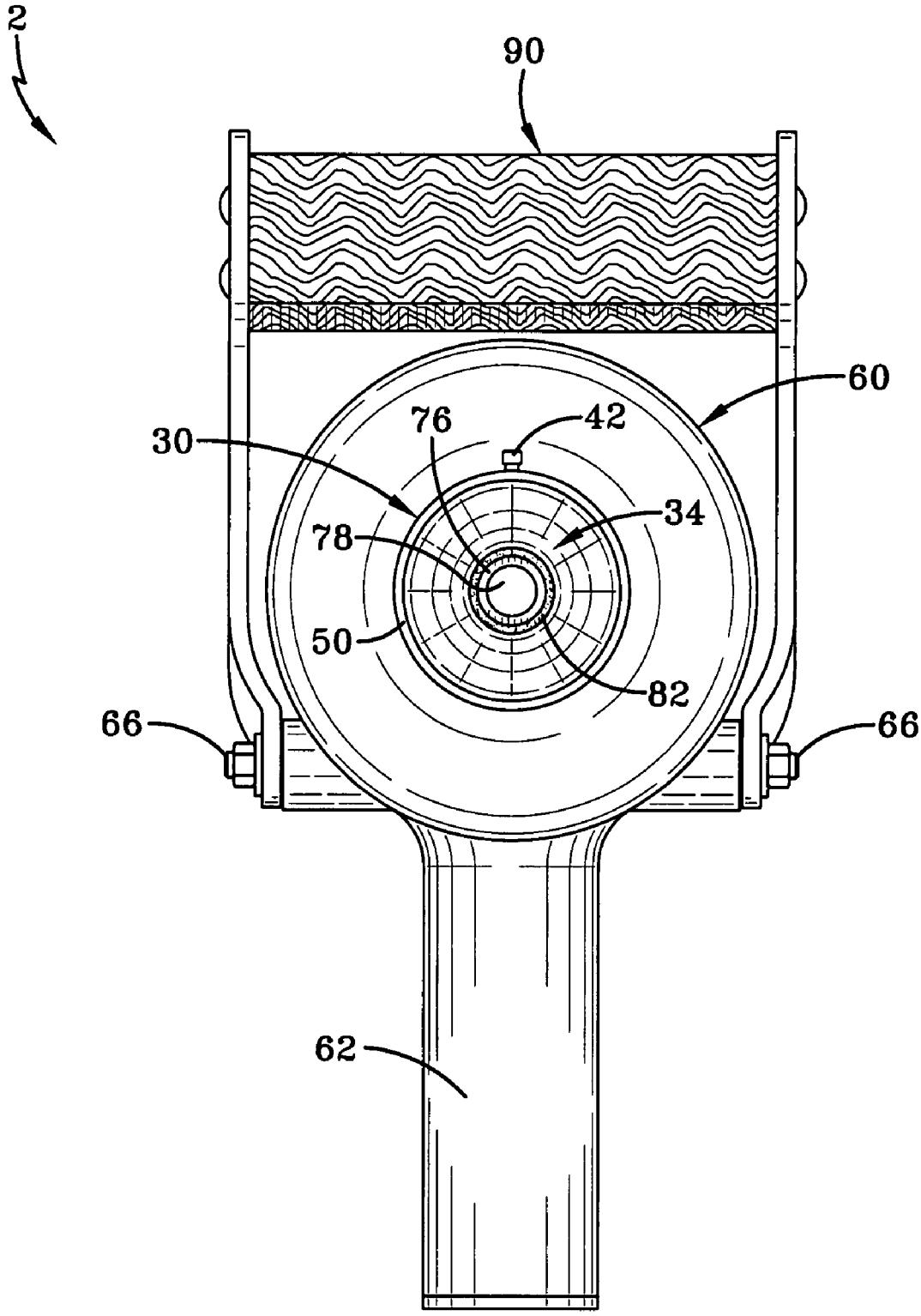
FIG. 6 is an end view of the present invention looking in the direction "R" as shown in FIG. 3.

As shown in FIGS. 2, 4 and 5, water supply conduit 76 is adjacent air supply conduit 74 at rear surface 70; water supply conduit 76 penetrates air supply conduit 74 at "P"; and thereafter water supply conduit 76 is approximately concentric with air supply conduit 74 at outlet 72 of air supply conduit 74. Note, that (in the preferred embodiment), at outlet 72, water supply conduit 76 is inside air supply conduit 74. This configuration is preferred but not required. For example, air supply conduit 74 may be located outside water supply conduit 76, for example, the water supply may be attached to the air supply fitting at rear surface 70 and the air supply may be attached to the water supply fitting at rear surface 70, essentially reversing the supply hookups from that previously described. It is also not required that the two conduits be exactly or approximately concentric although concentricity is preferred. In addition, it is to be understood that both air supply conduit 74 and water supply conduit 76 may each convey different substances such as, gases, liquids or other substances. It is also to be understood that for clarity purposes, the use of the term water supply conduit and air supply conduit has been and will continue to be hereinafter used but that these meanings will be understood to mean that any substances or gases or fluids may be conveyed by each or both of said conduits without departing from the spirit of the invention. In addition, the use of the term first conduit and second conduit may be used to denote either one or the other, respectfully of said conduits. Gases, fluids and other substances, such as aerosols, powders, slurries, paints, premixed solutions, chemicals, and grains and the like, may be conducted by the two or more conduits to C-D nozzle 34. A fitting (not shown) may be attached to conduit 76 proximate rear surface 70 so that a water supply source may easily be attached to conduit 76.

Water supply conduit 76 includes ball valve 80, see FIGS. 2 and 4, which meters or controls the flow of water (or other substance or substances) in water supply conduit 76. Ball valve 80 includes or is attached to valve actuation rod 66 which may extend outwardly from one or both sides of ball valve 80, through housing 60, and extend(s) a distance outside of housing 60. Bail handle 90 may then be attached to valve actuation rod 66 on one or both sides of housing 60. Rotation of bail handle 90 about the axis of valve actuation rod 66 in a first direction (clockwise, for example) closes ball valve 80 and reduces or completely stops the flow in water supply conduit 76. Rotation of bail handle 90 about the axis of valve actuation rod 66 in a second direction (counterclockwise, for example) opens ball valve 80 and increases the flow in water supply conduit 76. Operation of bail handle 90 may be accomplished by an operator using one hand while grasping grip 62 with the other hand.

Figure 3:
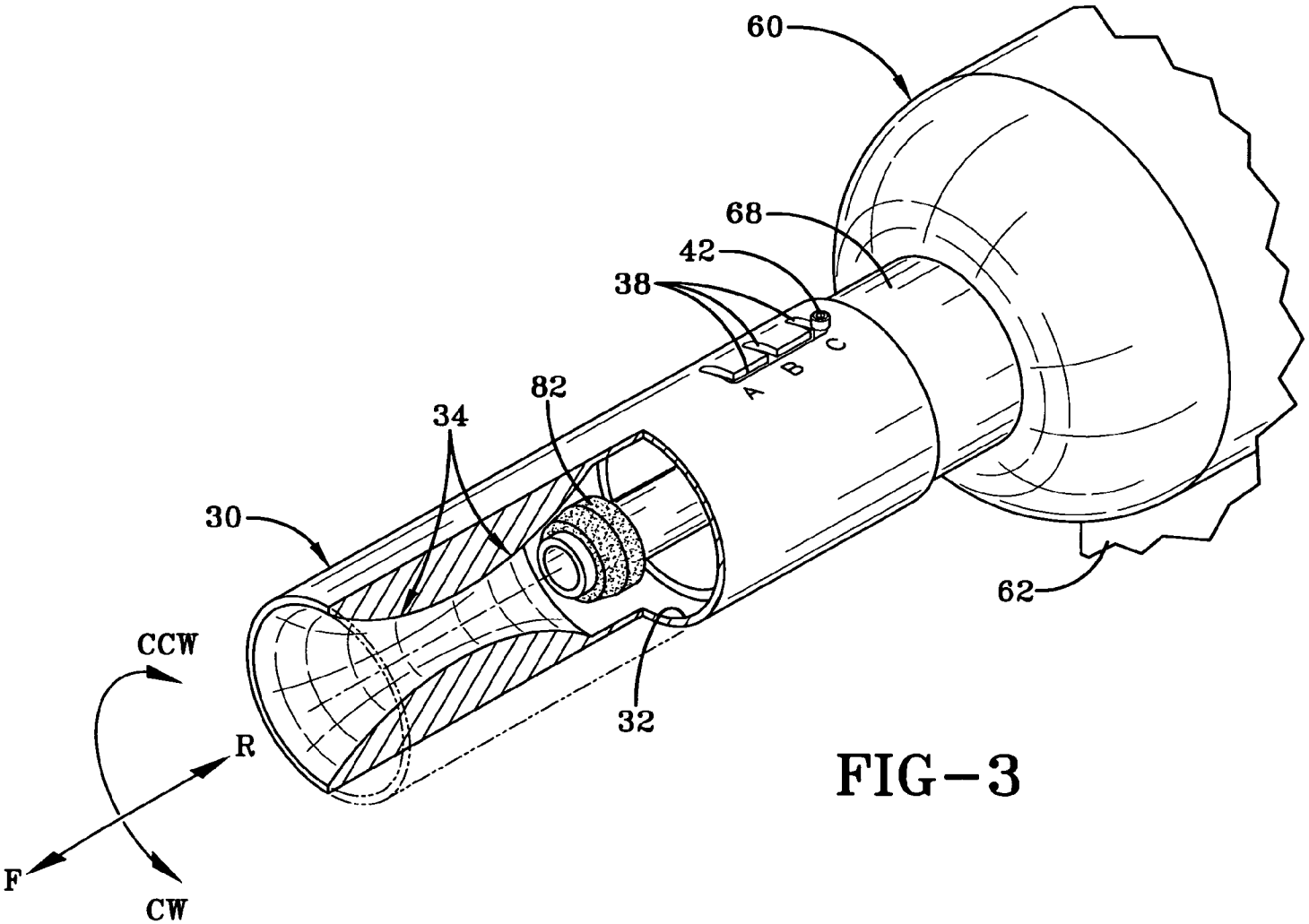
FIG. 3 is a perspective view showing the fluid activation sleeve.

Fluid activation sleeve 30 is located forwardly of housing 60 and is slidable and pivotally attached to nose 68 or to housing 60 if nose 68 is omitted. As best shown in FIG. 5, bore 32 of fluid activation sleeve 30 is a slip fit over nose 68 of housing 60 allowing fluid activation sleeve 30 to rotate both clockwise, CW, and counterclockwise, CCW, around nose 68 and to slide forwardly, F, and rearwardly, R, over nose 68 (See FIG. 3). In this way, C-D nozzle 34, which is located in fluid activation sleeve 30 and which will hereinafter be further described, may be adjusted to position C-D nozzle 34 in closer or farther proximity to outlet 78 of water supply conduit 76 and to outlet 72 of air supply conduit 74. Fluid activation sleeve 30 includes adjustment slot 38 located in the top portion of fluid activation sleeve 30 as shown in FIG. 3. Slot 38 extends through the top wall of sleeve 30 and includes 3 adjustment positions designated as A, B and C. Set screw 42 is located in threaded bore 40 of nose 68 and extends through slot 38. An operator may easily position fluid activation sleeve 30 in any of the 3 positions A, B or C by rotating and sliding fluid activation sleeve 30 so that set screw (or locking pin) 42 is located in either slot A, slot B or slot C. Set screw 42 is preferably flush with the outside surface of fluid activation sleeve 30. This is but one way to position (and lock, if desired) fluid activation sleeve 30, with C-D nozzle 34 located therein, relative to water supply conduit 76 and air supply conduit 74. Other methods of positioning may be employed by those skilled in the art. Other positions on either or both sides of position A and C or therebetween A or B or between B or C may be used or employed when other fluids or substances or mixtures thereof are desired to be mixed and dispersed by the present invention or when especially precise outcomes are desired.

C-D nozzle 34 is located in the forwardly portion of fluid activation sleeve 30 and includes a convergent portion "c" having major diameter "X" (i.e. the entry end) and minor diameter "Y" (i.e. the exit end), and a divergent portion "d" having a major diameter "Z" (i.e. the exit end) and a minor diameter "Y" (i.e. the entry end). In the preferred embodiment, there is no constant diameter portion between the convergent portion c and the divergent portion d. However, a constant diameter portion located between c and d may be employed. In the preferred embodiment, the diameter at Y equals ½ the diameter at Z and the diameter at Z equals the diameter at X.

When sleeve 30 is adjusted to the closed position, position "A", see FIG. 4, gasket 82 will seal around impingement area 44 on the inner circumference of the convergent portion c of C-D nozzle 34 and block all flow of air from air supply conduit 74 and, at the same time, ideally position outlet 78 of water supply conduit 76 exactly at or in close proximity to minor diameter y of C-D nozzle 34. In this way, adjustable liquid atomizing nozzle 2 will operate as a laminar flow device with only water being conducted through and discharged out of adjustable liquid atomizing nozzle 2. Flow is laminar since the diameter (and X-sectional area) of water supply conduit 76 at outlet 78 is just slightly less than the diameter (and X-sectional area) of C-D nozzle 34 at y, the minor diameter of C-D nozzle 34. It should be noted, that gasket 82 may be eliminated and the same affect accomplished by shaping the outer surface of water supply conduit 76 to conform to the shape of impingement area 44 on the inner circumference of convergent portion c. In this way, water supply conduit 76 will seal around impingement area 44 without a gasket and block all flow of air from air supply conduit 74.

Note, that in the preferred embodiment, C-D nozzle 34, water supply conduit 76 and air supply conduit 74 remain concentric about axis S-S (see FIGS. 4 and 5) from exit 50 to a point rearwardly of outlet 72 of air supply conduit 74 when fluid activation sleeve 30 is in position A, B or C.

When sleeve 30 is adjusted to the open position, position "C", see FIG. 5, gasket 82 (or the shaped outer surface of water supply conduit 76) is no longer seated at impingement area 44 and outlet 78 is positioned rearwardly of convergent mixing area 36. At the same time, outlet 78 of water supply conduit 76 is positioned at X, the major diameter of convergent portion c. Air (or other gas or fluid or substance) is now permitted to flow from outlet 72 of air supply conduit 74, around gasket 82 and into convergent mixing area 36. Simultaneously, water (or other fluid, gas or substance) is permitted to flow from outlet 78 of water supply conduit 76 into convergent mixing area 36. Note, that in the preferred embodiment, C-D nozzle 34, water supply conduit 76 and air supply conduit 74 remain concentric about axis S-S in this adjustment position C (and all other positions). Both air and water mix in convergent area 36. The air becomes increasingly compressed when mixed with the water in convergent mixing area 36 as both fluids move through convergent portion c and towards minor diameter Y of throat area 48. Both fluids continue to push through minor diameter Y of throat area 48 where the air becomes highly compressed in the presence of the incompressible water. As the mixture passes through minor diameter Y and into divergent portion d of C-D nozzle 34, the highly compressed air rapidly expands in divergent area 25 and shears the water (large droplets) into a finely atomized array of water droplets which exit C-D nozzle 34 at exit 50, at high momentum and in an evenly distributed mist of a preferred 50-80 microns in diameter. Note that in the preferred embodiment, C-D nozzle 34, water supply conduit 76 and air supply conduit 74 remain concentric about axis S-S when fluid activation sleeve 30 is in position A, B or C.

Fluid activation sleeve 30 may also be adjusted to intermediate position B, see FIG. 3. In position B, fluid activation sleeve 30 is in an intermediate position relative to position A (wherein air supply conduit 74 is fully closed and water flow from water supply conduit 76 is laminar, as fully described hereinabove) and position C (wherein air supply conduit 74 is fully open and water from water supply conduit 76 is fully atomized as fully described hereinabove). It should be noted that the term "fully atomized" is to mean the maximum atomization that is possible within the range of adjustability available which may extend beyond position A or C. In position B, or any position between position A and position C, the atomization process can be tailored to accomplish any desired output flow between the laminar flow with no atomization (position A) and the fully atomized flow (position C). In position B, droplet sizes can be adjusted from less than 100 microns (50-80 microns is preferable but smaller sizes can be obtained) through any range up to laminar flow. This adjustability permits the operator to make on the spot and real time adjustments to instantaneously adapt the output to a particular situation, process or application. For example, a pollution prevention process may require the operator to wash the surfaces before cleaning the air in a smoke stack. The operator, by adjusting the invention through the range of position B, can accomplish this task by making available adjustments as described hereinabove. It should be noted that position B, as shown in the Figures, is but one position between positions A and C. There can be several positions between positions A and C such as B1, B2, (not shown) etc. Likewise, there may be positions outside the A and C positions. Positions A, B and C were chosen for the purpose of describing the characteristics of the present invention and it is to be understood by those skilled in the art, that other positions may be effected. Larger droplets are formed the closer position B is in relation to position A. Likewise, smaller droplets are formed the closer position B is to position C with the smallest atomization occurring at position C.

Accordingly, this combination of the present invention produces a highly effective apparatus and process that provides efficient and effective atomization that will produce droplet sizes of less than 100, and preferably in the range of 50-80 microns, at low pressures of less than 20 pounds per square inch (PSI) in water supply conduit 76 and/or less than 20 PSI in air supply conduit 74 when using air in air supply conduit 74 and when using water in water supply conduit 76, respectively and placing fluid activation sleeve 30 in adjustment position C. This is achieved in a device that is compact and that may easily be held and directionally controlled by one hand of an operator.

Obviously, many modifications and variations of the present invention are possible in light of the above teachings. It is therefore to be understood that within the scope of the appended claims, the invention may be practiced other than as specifically described.

What is claimed is:

1. An apparatus for mixing two or more fluids, gases or other substances in any combination thereof, comprising:

a) a housing having a nose portion and a gripping portion, said housing including an outer conduit and at least one inner conduit, said outer and inner conduits positioned and arranged to convey liquids, fluids and other substances from an entry point to an exit point, said exit point of at least one inner conduit located forwardly of said outer conduit;

b) a fluid activation sleeve slidably attached to said nose portion, said fluid activation sleeve having a C-D nozzle therein, said C-D nozzle including a convergent portion of changing X-sectional area and having an entry end and an exit end, said entry end having a larger X-sectional area than the X-sectional area of said exit end, said C-D nozzle also having a divergent portion of changing X-sectional area and having an entry end and an exit end, said entry end having a smaller X-sectional area than the X-sectional area of said exit end, said exit end of said convergent portion abutting and attached to said entry end of said divergent portion, said exit end of said convergent portion and said entry end of said divergent portion having the minimum X-sectional area of said C-D nozzle, said entry end of said convergent portion located proximate said exit point of said inner conduit, said fluid activation sleeve slidably adjustable to alter the distance between said C-D nozzle and said exit end of said inner conduit to position said C-D nozzle from a most rearwardly position blocking off the flow of said fluids, gases or other substance from said outer conduit and allowing only fluids, gases or other substances to flow from said inner conduit to a most forwardly position permitting said fluids, gases or other substances to flow from said outer conduit and mix with said fluids, gases or other substances from said inner conduit in said convergent portion of said C-D nozzle.

2. The apparatus defined in claim 1, wherein the inner conduit is a water supply conduit, and the apparatus further including a valve located in said water supply conduit for independently adjusting the flow of water in said water supply conduit.

3. The apparatus defined in claim 2, further including a bail handle attached to said valve for adjusting by one hand of an operator while the other hand of said operator is simultaneously gripping said grip.

4. The apparatus defined in claim 1, wherein said inner conduit has an outlet, and wherein said fluid activation sleeve is adjustable to position said outlet of said inner conduit between said exit end of said convergent portion and said entry end of said convergent portion.

5. The apparatus defined in claim 1, wherein the length of said convergent portion of said C-D nozzle is approximately equal to the length of said divergent portion of said C-D nozzle.

6. The apparatus defined in claim 5, wherein the minimum diameter of said convergent portion of said C-D nozzle is attached to and abuts said minimum diameter of said divergent portion of said C-D nozzle.

7. The apparatus defined in claim 1, wherein said inner conduit is a water supply conduit and said outer conduit is an air supply conduit said water supply conduit and said air supply conduit each having an outlet, and wherein said C-D nozzle, said outlet of said water supply conduit and said outlet of said air supply conduit are positioned and arranged to produce water droplets of less than 100 microns in diameter.

8. The apparatus defined in claim 7, wherein said C-D nozzle, said water supply conduit and said air supply conduit each include an axis and wherein said axes of said C-D nozzle, said water supply conduit and said air supply conduit are substantially concentric.

9. The apparatus defined in claim 1, wherein said inner conduit has an outlet, and said fluid activation sleeve is adjusted to position the outlet of the inner conduit rearwardly of said entry end of said convergent portion.

10. An apparatus for producing finely atomized droplets of a liquid, gas or other substance, comprising:

a) a C-D nozzle having a convergent portion and a divergent portion, the C-D nozzle having a convergent inlet portion and a divergent exit portion located downstream of said convergent portion;

b) a conveyance portion located upstream of said convergent portion;

c) a first conduit conveying said liquid, gas or other substance to be finely atomized into said convergent inlet portion of said C-D nozzle, said liquid, gas or other substance under pressure;

d) a second conduit conveying a compressible, shearing liquid, gas or other substance into said conveyance portion, said compressible, shearing liquid, gas or other substance under pressure, said C-D nozzle, said first conduit and said second conduit positioned and arranged to introduce the liquid, gas or other substance from said first conduit to commingle, mix and compress with the liquid, gas or other substance from said second conduit in said convergent portion of said C-D nozzle and expand, shear and exit from said divergent portion of said C-D nozzle in a finely atomized flow, said C-D nozzle, said first conduit and said second conduit are arranged in a concentric manner, said C-D nozzle may be moved concentrically, upstream or downstream of said first and second conduit.

11. The apparatus defined in claim 10, wherein said conveyance portion is fixed.

12. The apparatus defined in claim 11, further including a valve for independently adjusting the flow from said first conduit.

13. The apparatus defined in claim 12, wherein said first conduit is located inside said second conduit.

* * * * *